United States Patent [19]

Olson

[11] Patent Number: 4,631,007

[45] Date of Patent: Dec. 23, 1986

[54] PRESSURE PUMP HAVING JAWS AND END-SLOTS

[75] Inventor: Raymond G. Olson, Niles, Ill.

[73] Assignee: Baxter Travenol Laboratories, Inc., Deerfield, Ill.

[21] Appl. No.: 749,604

[22] Filed: Jun. 27, 1985

Related U.S. Application Data

[60] Division of Ser. No. 572,496, filed as PCT US83/00528, Apr. 11, 1983, published as WO83/04285, Dec. 8, 1983, § 102(e) date Oct. 24, 1983, Pat. No. 4,540,351, which is a continuation-in-part of Ser. No. 380,977, May 24, 1982, abandoned.

[51] Int. Cl.[4] ..... F04B 43/12; A61M 1/00; A61M 25/00

[52] U.S. Cl. ..... 417/476; 604/153

[58] Field of Search ..... 417/477, 476; 418/45; 604/153; 128/DIG. 12

[56] References Cited

U.S. PATENT DOCUMENTS 2,899,904 8/1959 Becher ..... 417/477

4,211,519 7/1980 Hogan ..... 417/360

4,416,595 11/1983 Cromie ..... 417/476

*Primary Examiner*—John J. Vrablik

*Attorney, Agent, or Firm*—Paul C. Flattery; Garrettson Ellis; Daniel D. Ryan

[57] ABSTRACT

A pressure pump for fluids having a pressure member 12, 12*a* of generally circular periphery, means 14, 14*a* for moving the pressure member in an orbital motion about an axis of rotation, and a sleeve member 16, 16*a* made of a pair of hinged jaws 22, 22*a* positionable about the pressure member and spaced for receiving and retaining flexible tubing 18, 18*a* in an annular space between the pressure member and the sleeve member with the tubing surrounding the pressure member for pumping of fluids through the tubing. In accordance with this invention the jaws define end surfaces which abut together in the closed position having slots 34, 34*a* defined through the end surfaces communicating between the annular space and the outside to receive lengths of the flexible tubing occupying the annular space and extending into and out of the annular space through the slots.

2 Claims, 6 Drawing Figures

FIG. 1
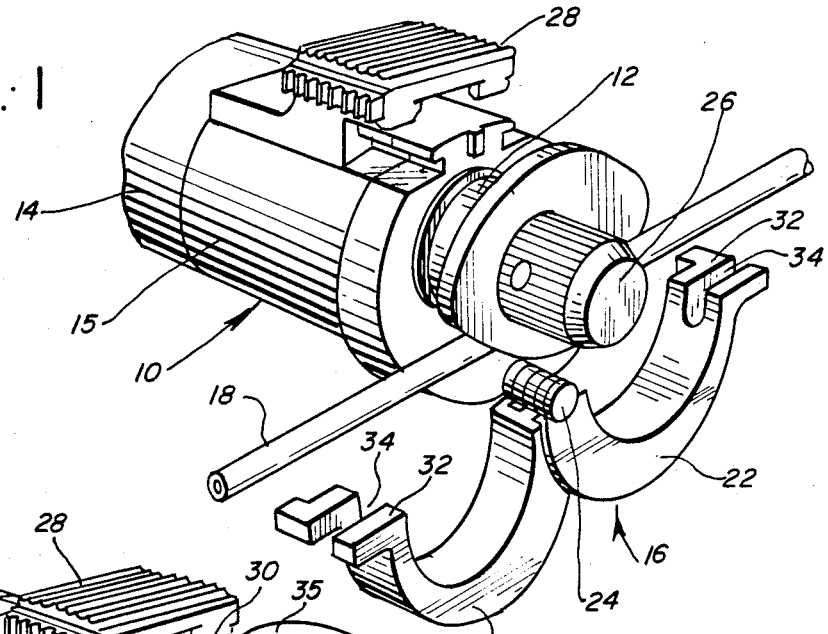
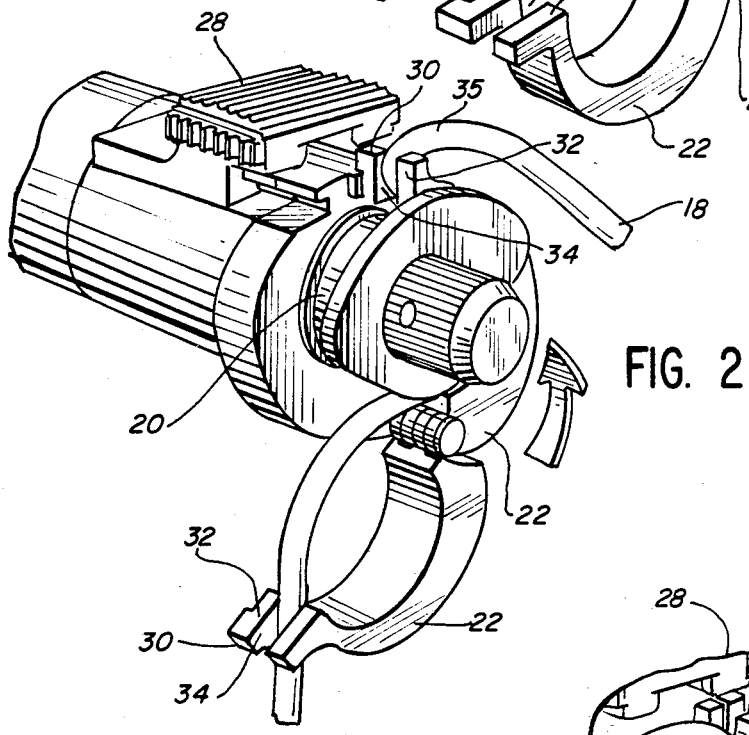
FIG. 2
FIG. 3
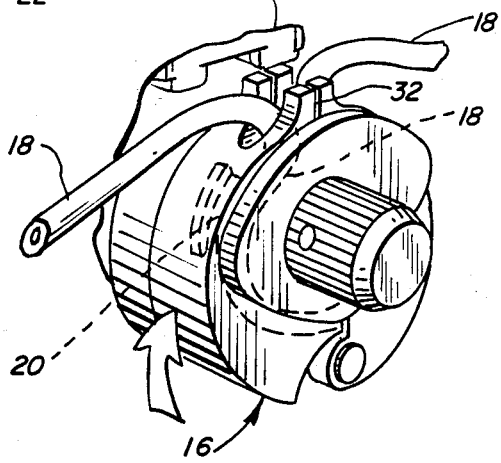
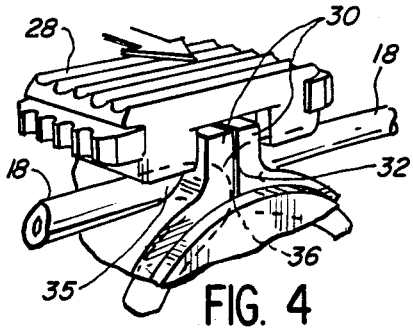
FIG. 4

PRESSURE PUMP HAVING JAWS AND END-SLOTS

This is a division of application Ser. No. 572,496, filed Oct. 24, 1983, now U.S. Pat. No. 4,540,351, which is a continuation-in-part of application Ser. No. 380,977, filed on May 24, 1982, now abandoned.

TECHNICAL FIELD AND PRIOR ART

In PCT International Publication No. WO82/03254, entitled "MINIATURE ROTARY INFUSION PUMP WITH SLIDE LATCH AND DETACHABLE POWER SOURCE", (corresponding to Cromie U.S. Pat. No. 4,416,595), wearable pumps for continuous medicament administration are disclosed. As one type of use for such pumps, a chemotherapeutic agent or the like may be continuously administered to a tumor site of a patient, for example in the liver or pancreas, through an implanted catheter, while the infusion pump, being small enough to be carried or worn, continuously pumps a predetermined dose of chemotherapeutic agent on a continuous 24 hour a day basis. Excellent clinical results have been achieved by this type of treatment. Alternatively, medicines or other solutions having higher dosage requirements may also be applied by the pump.

It is, of course, most desirable for the patient to be able to load new supplies of solution into such a pump for controlled 24 hour delivery thereof. However, since the pump may be small to be wearable and since the patient may be elderly or debilitated, it is desirable for the loading technique to be as simple and as foolproof as possible. While the cited PCT publication represents an improvement in this respect over the devices of respectively U.S. Pat. No. 3,908,657, and Belgian Patent No. 886,687 entitled "MINIATURE INFUSION PUMP", this present application in turn provides an improvement in the ease and foolproof characteristic of loading of a tiny solution bag into a small, wearable pump in which the tubing is properly positioned for the desired reliable pumping which can be provided by the pump of this invention. Thus by this invention the therapy which is available through a miniature pump capable of administering medication on a 24 hour basis becomes available to even more people despite visual handicaps, age, and state of debilitation, to open up this promising therapy to such people without the need of as frequent medical supervision, permitting the people to live at home and to go about daily activities while being treated. This pump can be used to pump a self-contained, small bag of solution, and it can be also used to pump larger volumes of parenteral and other solution as desired.

DESCRIPTION OF THE INVENTION

In accordance with this invention a pressure pump for fluids through flexible tubing is provided which comprises a pressure member of generally circular periphery and means for moving the pressure member in orbital motion about an axis of rotation. A sleeve member is also positioned about the pressure member and spaced for receiving and retaining the flexible tubing in an annular space between the pressure member and the sleeve member, with the tubing surrounding the pressure member for pumping of fluids through the tubing.

The sleeve member is divided into a pair of jaws attached together at one end in hinged relation to permit opening and closing of the jaws about the pressure member to facilitate installation of the tubing.

In accordance with this invention, the jaws define end surfaces which abut together in the closed position, and slots defined through the end surfaces communicating between the annular space and the area outside the pressure pump to receive lengths of the flexible tubing occupying the annular space and extending into and out of the annular space through the slots.

The slots are preferably proportioned to cause the lengths of tubing in the slots to abut together while the jaws are closed, to reduce the possibility of fluid leakage through the tubing when the pressure member is displaced in its orbital motion toward the abutting lengths of tubing in the slots. Thus it becomes possible for no leakage to take place through the tubing when the pressure pump is stopped, irrespective of the orbital position of the pressure member, since the tubing will be compressed, blocking flow, by the orbital member in any of its orbital positions.

It may also be preferable for the slots to permit the lengths of tubing therein to each be folded about an angle of substantially 180°. This provides room for latch means to be provided to retain the jaws in closed position. When it is desired to open the jaws, the latch means is removed from engagement with the jaws to permit their opening. The latch means can be a sliding member or any other type of latching means.

Alternatively, added slot means can be formed into the latch means which engages the jaws. The lengths of tubing thus do not have to be folded about an angle of substantially 180° but instead can pass upwardly through the slot in the latch means. This avoids any possible kinking of the tubing that may be caused by folding it about the angle of substantially 180° as described above.

DESCRIPTION OF THE DRAWINGS

Referring to the drawings,

FIG. 1 is a perspective view of the pressure pump of this invention with the jaws in fully open position in preparation for loading of the flexible tubing.

FIG. 2 is another perspective view of the pressure pump showing how one jaw can be rotated to its closed position and the tube threaded through the slot on the end surface thereof.

FIG. 3 is a fragmentary perspective view showing how the other jaw can be brought to its closed position and the tubing threaded through the slot and the end surface thereof in similar manner to the first jaw.

FIG. 4 is a fragmentary perspective view showing how one form of latch means can be brought forward to retain the jaws in closed position.

DESCRIPTION OF SPECIFIC EMBODIMENT

Figure 5:
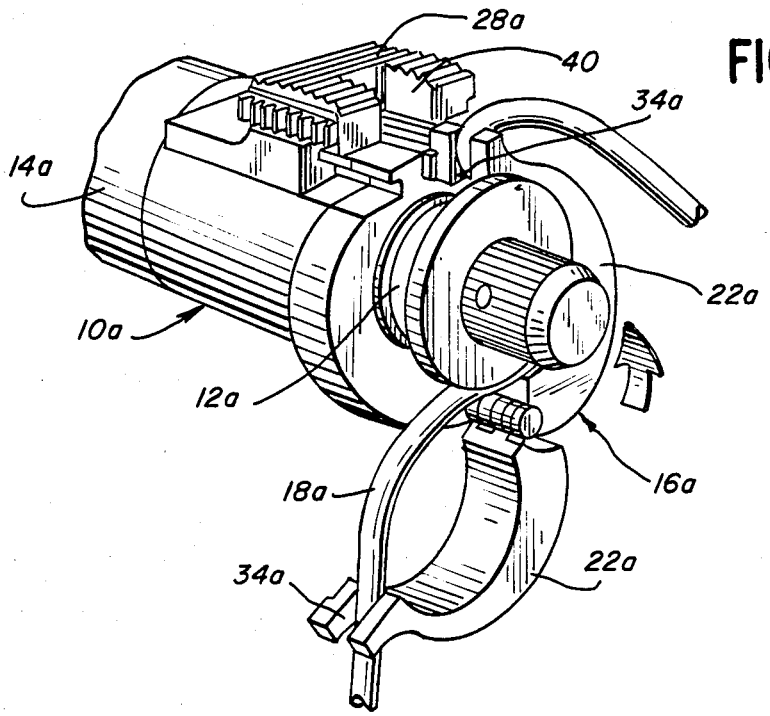
FIG. 5 is a perspective view of an alternative embodiment of the pressure pump of this invention, shown in a configuration similar to that of FIG. 2.

Referring to FIGS. 1 through 4, a pressure pump 10 in accordance with this invention is provided. Pressure pump 10 may be carried by any type of casing that may be desired, typically for example in the manner of the previously cited PCT publication, and the details of the pressure pump of this invention may be similar to the structure of that PCT publication or alternatively the cited U.S. Pat. No. 3,908,657, except as otherwise disclosed herein.

Pressure pump 10 includes a pressure member 12 of generally circular periphery, rotatably attached to a crank on a shaft which is rotatable by motor 14, through gear box 15, so that pressure member 12 moves in orbital motion about an axis of rotation to achieve the orbital motion.

Sleeve member 16 is positionable about the pressure member and spaced for receiving and retaining flexible tubing 18 in an annular space 20 which is definable between the pressure member 12 and sleeve member 16 for pumping of fluids through the tubing by the orbital motion of pressure member 12.

Sleeve member 16 is divided into a pair of jaws 22 attached together at one end in hinged relation about pin 24 to permit opening and closing of jaws 22 about pressure member 12, to facilitate installation of tubing 18.

Knob 26 may be provided for manual rotation of the crankshaft that carries pressure member 12, to orbitally move the pressure member to facilitate the installation of tubing 18. Also, sliding latch 28 is provided to latch jaws 22 into their closed position by sliding about latching projections 30, to prevent the reopening of jaws 22 during operation as particularly shown in FIG. 4. The specific design of latch member 28 may be as disclosed in previously cited PCT publication.

In accordance with this invention, jaws 22 each define end surfaces 32 which abut together in the closed position as shown for example in FIGS. 3 or 4. Slots 34 are defined through end surfaces 32, being proportioned to communicate between annular space 20 and the outside of pressure pump 10 to receive lengths of tubing 18 which extend from the exterior into annular space 20, and once again extending out of annular space 20 into the exterior region about pump 10. Accordingly, tubing 18 may connect at one end to a container of solution which is to be administered to a patient, and at its other end to a catheter communicating with the arteriovenous system of a patient, and optionally extending to an actual organ of the patient, for example a tumor site at the liver, the pancreas, or elsewhere. When jaws 22 are in their closed position, the orbital motion of pressure member 12 causes solution to be pumped through tubing 18 at an exactly predetermined, low volume rate in a manner dependent upon the velocity of such orbital motion of pressure member 12.

As can be seen in FIG. 2, tubing 18 can be folded in each slot 34 about an angle of substantially 180° so that the tubing within annular space 20 undergoes a substantially 180° bend as it extends through slot 34, with the exterior length 35 of tubing 18 extending in substantially the opposite direction from tubing at the other side of slot 34 as it extends out of slot 34. Since slot 34 permits each of the lengths of tubing within them to be bent in this manner, it becomes possible to slide latch 28 into engagement with projections 30 of jaws 22 without interference with tubing 18.

It is also preferred for slots 34 to be so proportioned that lengths of tubing 18 in the slots abut together while the jaws are closed. For example, note abutting surfaces 36 of tubing 18 in FIG. 4. This reduces the possibility of fluid leakage through tubing 18 in the circumstance where pressure member 12 is displaced in its orbital motion toward the abutting lengths of tubing in slots 34. In other words, because of the orbital positioning of pressure member 12, the tubing in annular space 20 is always closed at one point, i.e., in that direction in which the pressure member is displaced from its center of orbital motion. However, if the sections of tubing within slots 34 were spaced from each other, the tubing might not be closed when the direction of orbital displacement of pressure member 12 is positioned between the two lengths of tubing in slots 34. However, when lengths of tubing within slots 34 abut each other, at least one segment of the tubing can be sealed closed by pressure member 12 in every possible orbital position of the pressure member, to avoid the risk of uncontrolled liquid flow through tubing 18.

The structure of this invention is very easy to load with tubing 18 so that it becomes more usable by an elderly or debilitated person. The basic steps of loading are illustrated by FIGS. 1–4. First, tubing 18 is placed between the open jaws 22 and pressure member 12. One of the jaws 22 is then closed as shown in FIG. 2, and tubing 18 placed into slot 34 and bent double into an angle of approximately 180°. The other jaw 22 is then closed, with tubing 18 placed in the other slot 34 as shown in FIG. 2 to achieve the configuration of FIG. 3. Thereafter, the segments of tubing 18 are stretched down into their bent, 180° relationship by pulling downwardly, and latch 28 is passed over the jaws and tubing to form the latched configuration of FIG. 4.

Thereafter, pump 10 can be operated, with liquid passing through tubing 18 in a manner which is entirely dependent upon the rate of orbital motion of pressure member 12.

The configuration of the pump of this invention is also advantageous because it avoids the situation where the tubing is wound about the pressure member more than 360°. This results in a higher flow capacity, when compared with prior models of the pump operating at equal power outputs. Thus the battery operated pumps will last longer when designed in accordance with this invention, all else being equal, and higher flow capacities can be achieved.

Pressure sensing means may be provided as a safety measure to shut off the pump in the event of an occlusion or blockage of the pump output.

Figure 6:
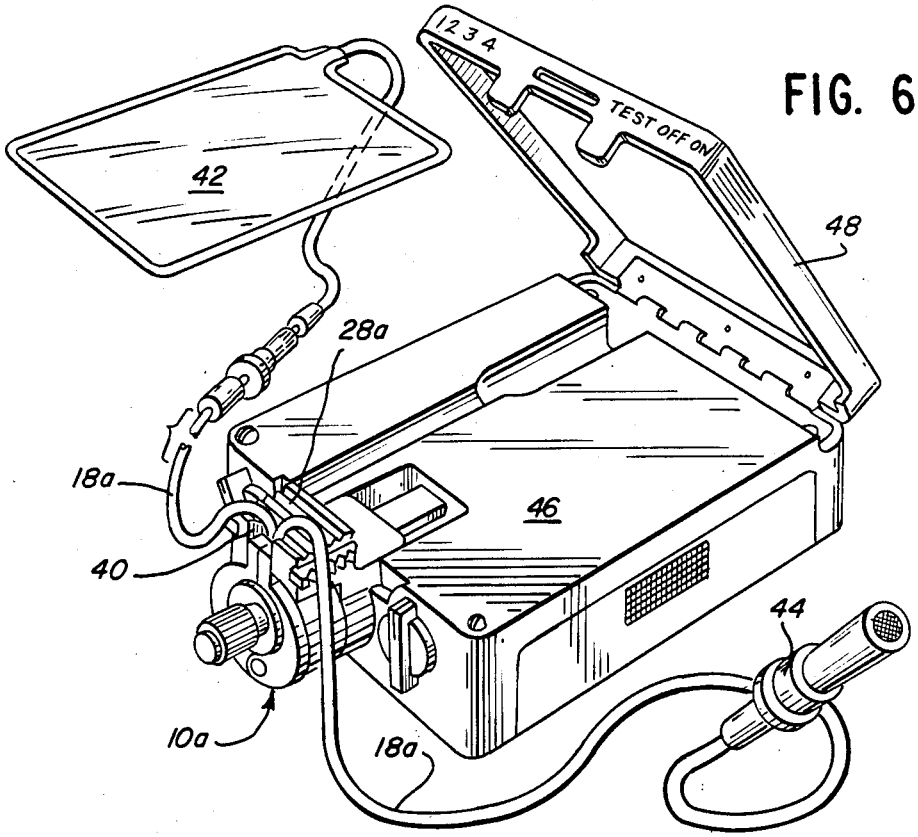
FIG. 6 is a perspective view of the pressure pump of FIG. 5, shown carried in a housing, with the pump carrying tubing connecting between a small bag of solution at one end and a catheter at the other end, and showing the latch means in closed position with the tubing passing therethrough.

Referring to FIGS. 5 and 6, a pump design is shown which may be identical to that of FIGS. 1 through 4 except as otherwise indicated herein.

Pressure pump **10*a* includes pressure member 12*a* which is rotatable by motor 14*a* in a manner similar to the previous embodiment. Sleeve member 16*a*, divided into jaws 22*a*, is provided to receive tubing 18*a* in the space defined between pressure member 12*a* and sleeve 16*a* when jaws 22*a*** are in their closed position, all as in the previous embodiment.

Sliding latch **28*a* is provided as previously described, and may be of identical design to the previous embodiment and to that of the cited PCT publication except for the presence of cut away slot 40 positioned with its open mouth at the front end of sliding latch 28*a*. Accordingly, tubing 18*a*, when mounted in pump 10*a*, does not have to bend into a substantially 180° angle as in the embodiment of FIGS. 1 through 3, but instead tubing 18*a* can extend upwardly through end slots 34*a* of jaws 22*a*, and then through slot 40 of latch 28*a*, forming an angle of approximately 90° with the lengths of tubing occupying slots 34*a* in typically abutting relation, to eliminate any possibility of occlusion of tube 18*a* by kinking. Thus, tubing 18***a* can communicate with a bag of solution 42 at one end and with a catheter adapter 44, for example, at its other end.

Bag 44 may be retained within housing 46, which also carries pump 10*a* as shown. Housing 46 has a hinged lid 48 which may be latched by latch member 28*a* in a manner described in further detail in the cited PCT publication. Pump housing 46 and its ancillary parts may also be of the design cited in that publication.

Alternatively, bag 42 may be a liter of parenteral solution hanging from an IV pole, with pump 10*a* being also attached to the IV pole for precise administration of large volume parenteral solutions or, if desired, large volumes of enteral solutions in an enteral feeding system through the gastrointestinal tract. The speed of the pump can be controlled by appropriate gearing to give any desired controllable range of flow volume. The pump of this invention may, of course, carry a battery, or may be powered by any desired power source.

The above has been offered for illustrative purposes only, and is not intended to limit the scope of the invention of this application, which is as defined in the claims below.

That which is claimed is:

1. In a pressure pump for conveying fluids through tubing which comprises a pressure member of generally circular periphery, means for moving said pressure member in orbital motion about said pressure member and spaced for receiving and retaining the flexible tubing in an annular space between the pressure member and the sleeve member with the flexible tubing surrounding said pressure member for pumping of fluids through said flexible tubing, the sleeve member being divided into a pair of jaws hinged together at one end to permit opening and closing of the jaws about the pressure member to facilitate installation of the flexible tubing, the improvement comprising, in combination:

said jaws including end surfaces which abut together when said jaws are in the closed position and means defining slots in said end surfaces for accommodating passage of said flexible tubing into and out of said annular space when said end surfaces of said jaws are in abutting relation, and movable latch means defining a slot for retaining said end surfaces of said jaws in abutting relation, said latch means being positionable adjacent a region of said flexible tubing when said end surfaces of said jaws are retained in abutting relation so that said flexible tubing which passes through said slots in said jaw end surfaces is folded about an angle which is substantially 180 degrees with said tubing extending from said abutting jaw surfaces.

2. A pressure pump as defined in claim 1 wherein said means which defines said slots in said jaw end surfaces is operative, when said jaw end surfaces are in abutting relation, for placing into abutment said flexible tubing passing through said slots in said jaw end surfaces.

* * * * *